US011081831B2

(12) United States Patent
Satoh et al.

(10) Patent No.: US 11,081,831 B2
(45) Date of Patent: Aug. 3, 2021

(54) WATERPROOF CONNECTOR

(71) Applicant: Yazaki Corporation, Tokyo (JP)

(72) Inventors: Akira Satoh, Makinohara (JP); Hisaya Shibata, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/871,199

(22) Filed: May 11, 2020

(65) Prior Publication Data

US 2020/0395709 A1 Dec. 17, 2020

(30) Foreign Application Priority Data

Jun. 14, 2019 (JP) ..... JP2019-111460

(51) Int. Cl.
*H01R 13/506* (2006.01)
*H01R 13/52* (2006.01)
*H01R 13/58* (2006.01)

(52) U.S. Cl.
CPC ..... *H01R 13/5208* (2013.01); *H01R 13/506* (2013.01); *H01R 13/5202* (2013.01); *H01R 13/5216* (2013.01); *H01R 13/5841* (2013.01); *Y10S 439/936* (2013.01)

(58) Field of Classification Search
CPC ..... H01R 13/5208; H01R 13/506; H01R 13/5202; H01R 13/5216; H01R 13/5841; Y10S 439/936
See application file for complete search history.

(56) References Cited

U.S. PATENT DOCUMENTS 5,720,629 A * 2/1998 Self, Jr. ..... H01R 13/5208 439/274
6,254,432 B1 * 7/2001 Yoshigi ..... H01R 13/5208 439/604
7,507,125 B2 * 3/2009 Okamura ..... H01R 13/506 439/680
7,594,821 B1 * 9/2009 Hasija ..... G06Q 40/04 439/271
8,591,243 B2 * 11/2013 Brune ..... H01R 13/5216 439/276
2006/0189192 A1 8/2006 Onoda et al.
2011/0104943 A1 * 5/2011 Suzuki ..... H01R 13/504 439/587
2018/0034172 A1 * 2/2018 Singhammer ..... H01R 43/20

FOREIGN PATENT DOCUMENTS

JP 2006-228683 A 8/2006
JP 2011-146338 A 7/2011

* cited by examiner

*Primary Examiner* — Tho D Ta
(74) *Attorney, Agent, or Firm* — Sughrue Mion, PLLC

(57) ABSTRACT

A waterproof connector includes a housing including a first tubular portion forming a first end of the housing and a second tubular portion forming a second end of the housing, an inner member to hold a terminal, a seal member having a wire insertion hole, the seal member being to be attached to the second tubular portion at the second end of the housing and a filler filling a space inside the housing and between the inner member and the seal member. The housing has a bent structure. The second tubular portion includes a recessed portion on an inner peripheral portion on a side where an inside corner of the bent structure of the housing is provided. The seal member includes a protruding piece to be fitted into the recessed portion when the seal member is attached to the second tubular portion.

10 Claims, 12 Drawing Sheets

WATERPROOF CONNECTOR

CROSS-REFERENCE TO RELATED APPLICATION

The present application claims priority to Japanese Patent Application No. 2019-111460 filed on Jun. 14, 2019, the entire content of which is incorporated herein by reference.

TECHNICAL FIELD

The present invention relates to a waterproof connector.

BACKGROUND

A related art waterproof connector having a waterproof and oil-proof property to be used in a vehicle such as an automobile includes a housing having a tubular shape, an inner member attached to one end side of the housing and holds a terminal, a seal member fitted into the other end side of the housing and seals a gap between an electric wire and the housing, and a filler made of a resin filling a space and solidified in the space between the inner member and the seal member in the housing (see, for example, see JP2006-228683A and JP2011-146338A).

Some of the related art waterproof connectors include a housing that is bent in the middle because a direction to which the connector is fitted to a mating connector is different from a direction to which the electric wire is drawn out from the connector. In such a waterproof connector in which the housing is bent, when the filler fills a gap between the inner member and the seal member in the housing, the filler may not be charged for the entirety of the gap, thereby creating an unfilled portion which is not charged with the filler.

In particular, in the housing in which a wall thickness varies along an axial direction of the connector, a recess is formed in a portion having a thin wall thickness. Then air in the recessed portion does not come out at the time of filling the filler, and the unfilled portion of the filler is easily generated.

SUMMARY

Illustrative aspects of the present invention provide a waterproof connector which can be satisfactorily filled with a filler and high sealing performance is ensured.

According to an illustrative aspect of the present invention, a waterproof connector includes a housing having a tubular shape and through which an electric wire is inserted, the housing including a first tubular portion forming a first end of the housing and a second tubular portion forming a second end of the housing, an inner member configured to hold a terminal connected to an end of the electric wire, the inner member being configured to be fitted to the first tubular portion at the first end of the housing, a seal member having a wire insertion bole through which the electric wire is inserted, the seal member being configured to be attached to the second tubular portion at the second end of the housing and a filler filling a space inside the housing and between the inner member and the seal member. The housing has a bent structure such that the first tubular portion and the second tubular portion are connected to each other with an axial direction of the first tubular portion and an axial direction of the second tubular portion intersecting each other. The second tubular portion includes a recessed portion on an inner peripheral portion of the second tubular portion on a side where an inside corner of the bent structure of the housing is provided. The seal member includes a protruding piece configured to be fitted into the recessed portion when the seal member is attached to the second tubular portion.

Other aspects and advantages of the invention will be apparent from the following description, the drawings and the claims.

BRIEF DESCRIPTION OF THE DRAWINGS

FIGS. 4A and 4B are views of explaining a housing of the waterproof connector shown in FIG. 2, in which FIG. 4A is a front view of a second tubular portion, and FIG. 4B is a sectional view taken along a line A-A in FIG. 4A;

FIGS. 6A and 6B are views explaining a seal member shown in FIG. 2, in which FIG. 6A is a perspective view as viewed from a front side, and FIG. 6B is a perspective view as viewed from a back side;

DETAILED DESCRIPTION

Figure 1:
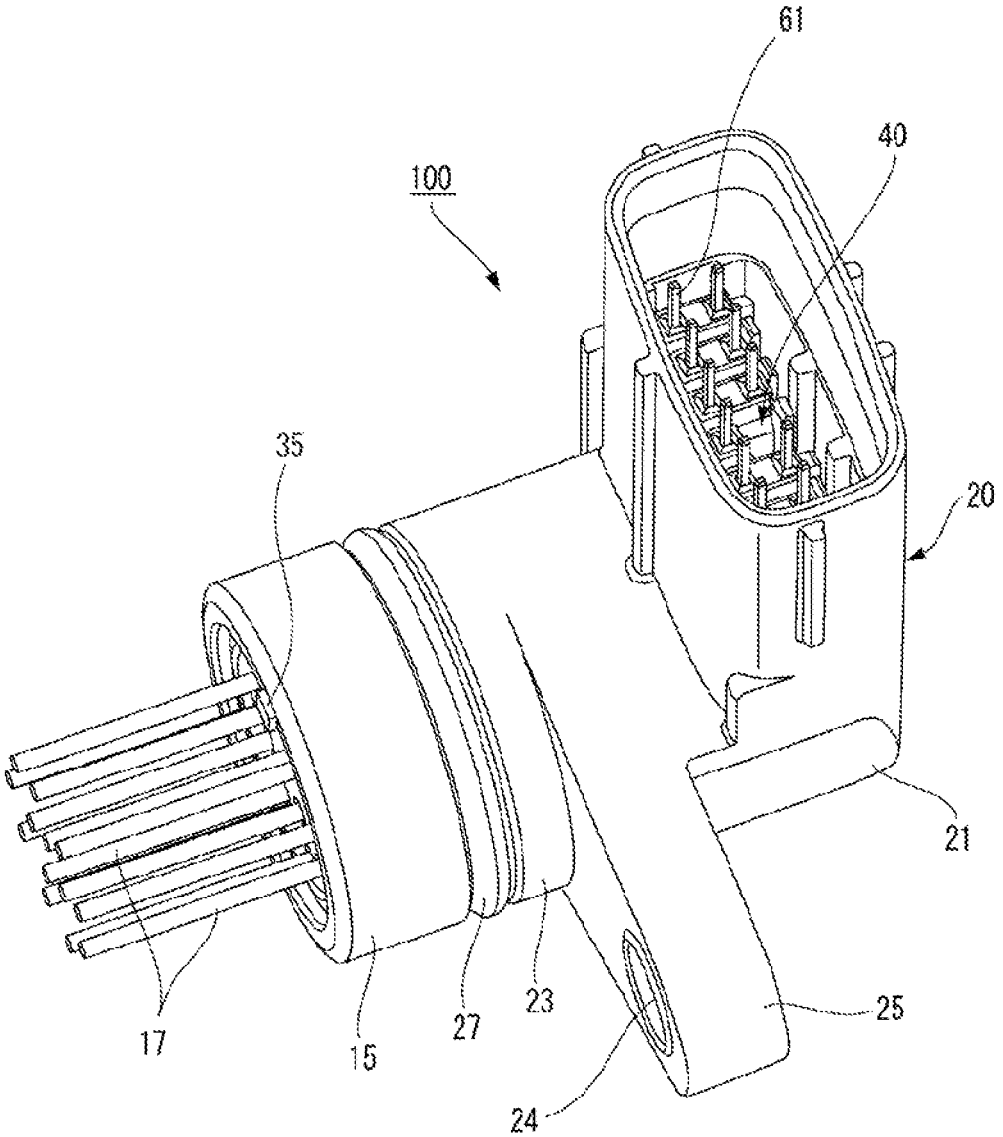
FIG. 1 is a perspective view of a waterproof connector according to an embodiment of the present invention.
Figure 2:
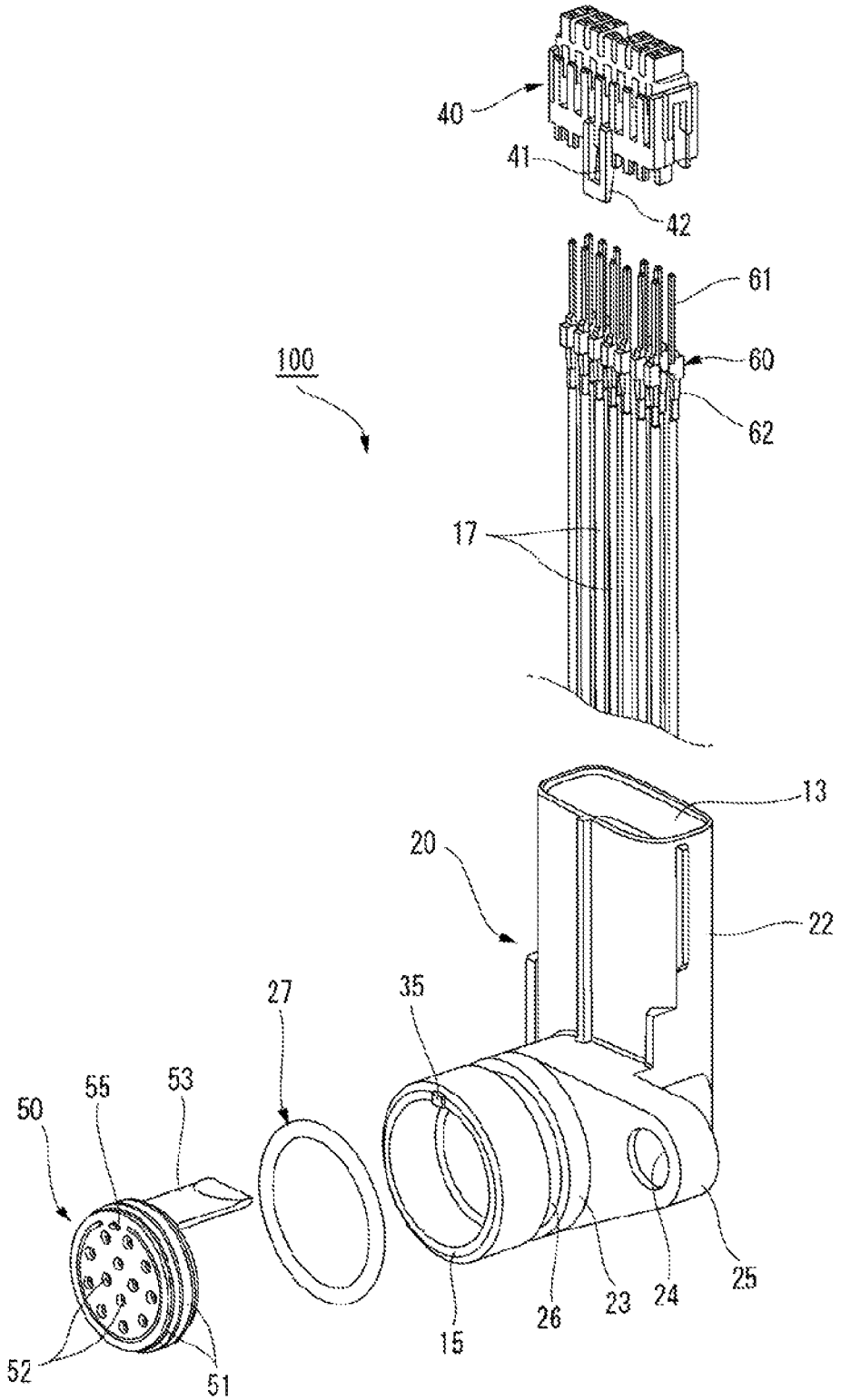
FIG. 2 is an exploded perspective view of the waterproof connector shown in FIG. 1.
Figure 3:
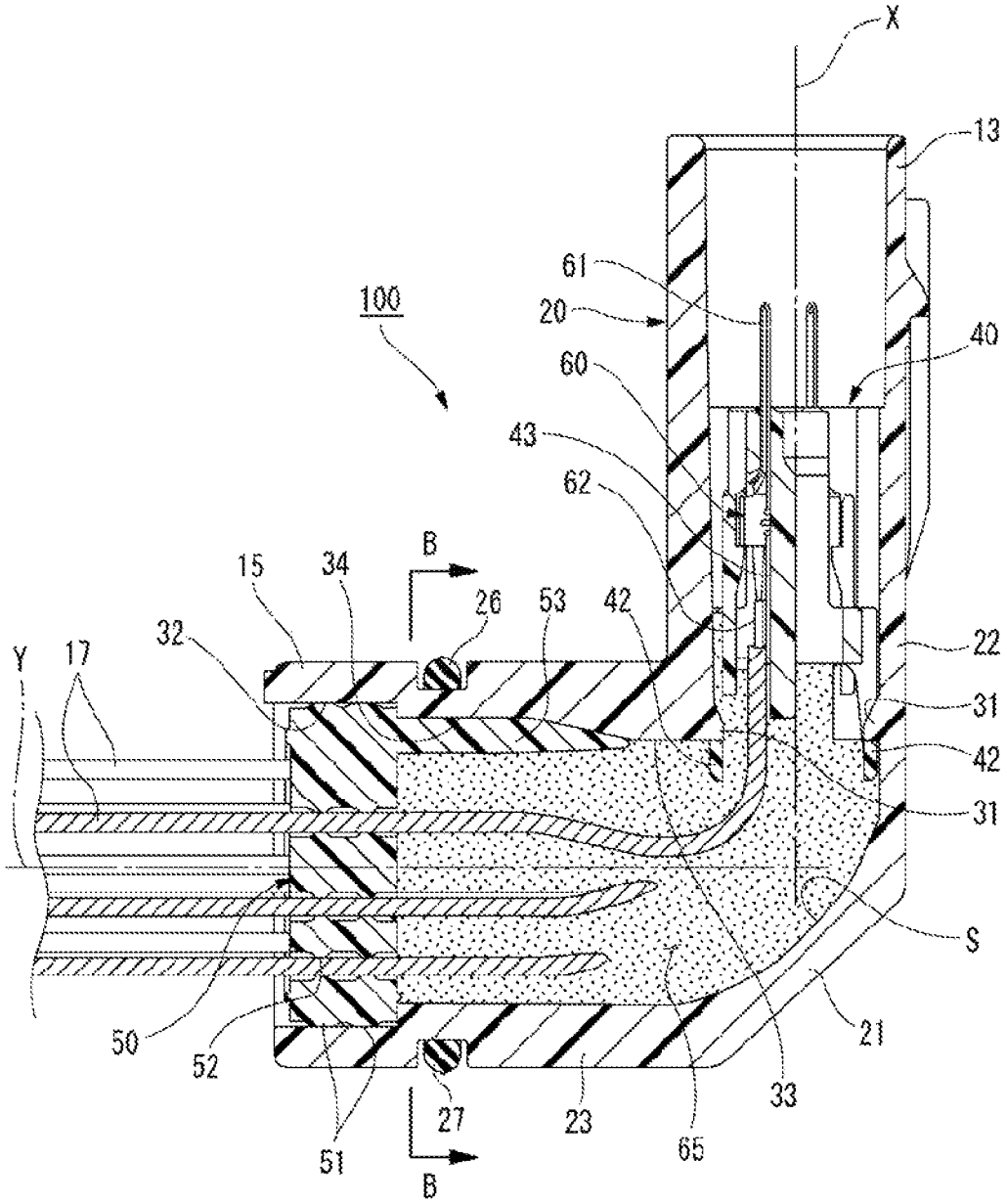
FIG. 3 is a longitudinal sectional view of the waterproof connector shown in FIG. 1 along an axial direction.

Hereinafter, exemplary embodiments of the present invention will be described in detail with reference to the drawings. FIG. 1 is a perspective view of a waterproof connector 100 according to an embodiment of the present invention. FIG. 2 is an exploded perspective view of the waterproof connector 100 shown in FIG. 1. FIG. 3 is a longitudinal sectional view of the waterproof connector 100 shown in FIG. 1 along an axial direction.

As shown in FIGS. 1 to 3, the waterproof connector 100 according to the embodiment of the present invention includes a housing 20, an inner member 40, a seal member 50, and a filler 65. The waterproof connector 100 includes a connection portion 13 to which a mating connector (not shown) is to be connected, and an electric wire draw-in portion 15. The waterproof connector 100 is attached to, for example, a case that accommodates a transmission of a vehicle. Electric wires 17 extending from an electrical component in the case are led into the electric wire draw-in portion 15. The mating connector (not shown) of a device such as a power source device and a control device provided outside the case in which the transmission is accommodated is connected to the connection portion 13.

The housing 20 is formed of a synthetic resin, and is formed in a tubular shape. The housing 20 is formed in a substantially L-shape having a bent portion 21 bent at approximately 90°. With the bent portion 21 as a boundary, the housing 20 has two portions, which are a first tubular portion 22 and a second tubular portion 23. In other words, the first tubular portion 22 and the second tubular portion 23 are connected with each other at the bent portion 21. The first tubular portion 22 has a first end (opening end) of the housing 20 which is an end of the first end tubular portion 22 opposite to the bent portion 21. The second tubular portion 23 has a second end (opening end) of the housing 20 which is an end of the second end tubular portion 23 opposite to the bent portion 21. An axial direction X of the first tubular portion 22 and an axial direction Y of the second tubular portion 23 intersect each other as a boundary of the first tubular portion 22 and the second tubular portion 23. A bending angle at the bent portion 21 between the first tubular portion 22 and the second tubular portion 23 of the housing 20 is not limited to 90°, and may be any angle as long as the axial directions X, Y intersect each other.

The first tubular portion 22 is formed in a rectangular tube shape, and the second tubular portion 23 is formed in a cylindrical shape. The housing 20 includes the connection portion 13 on a side of the first tubular portion 22 and the electric wire draw-in portion 15 on a side of the second tubular portion 23. The inner member 40 is fitted into and attached to the first tubular portion 22 of the housing 20. A fixing portion 25 having a bolt insertion hole 24 is formed in the second tubular portion 23 of the housing 20 so as to protrude laterally. The electric wire draw-in portion 15 is to be fitted into a mounting hole (not shown) formed in the case. Then, a bolt (not shown) inserted into the bolt insertion hole 24 of the fixing portion 25 is to be screwed into a screw hole (not shown) on a side of the case, whereby the waterproof connector 100 is attached to the case.

A seal groove 26 is formed on an outer peripheral portion of the second tubular portion 23 in a circumferential direction, and an O-ring 27 formed in an annular shape is to be fitted in the seal groove 26. The O-ring 27 is made of, for example, a synthetic resin material such as rubber. The O-ring 27 contacts an inner peripheral surface of the mounting hole by fitting the electric wire draw-in portion 15 into the mounting hole of the case. As a result, a space between the case and the electric wire draw-in portion 15 of the housing 20 is sealed.

Figure 4A:
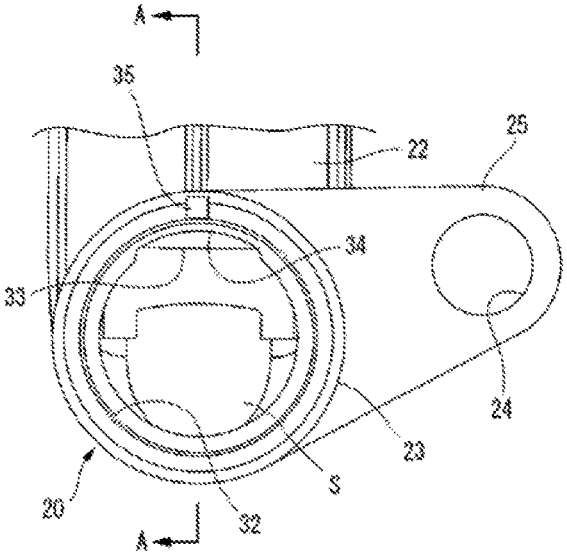
Figure 4B:
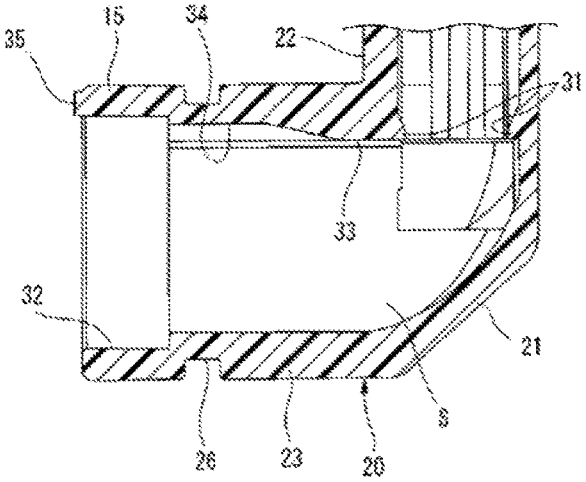
Figure 5:
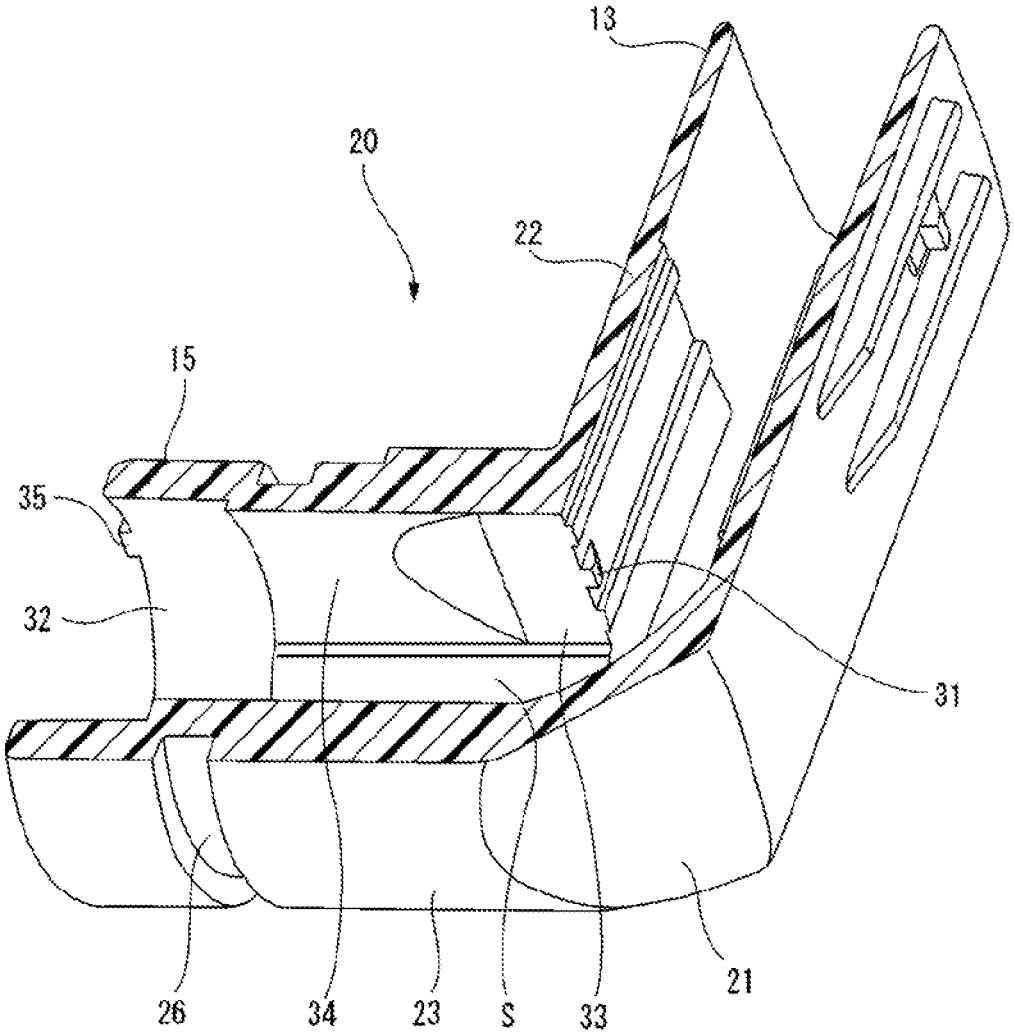
FIG. 5 is a partially cutaway perspective view explaining the housing of the waterproof connector shown in FIG. 2.

FIGS. 4A and 4B are views explaining the housing 20 of the waterproof connector 100 shown in FIG. 2, in which FIG. 4A is a front view of the second tubular portion 23, and FIG. 4B is a sectional view taken along a line A-A in FIG. 4A. FIG. 5 is a partially cutaway perspective view for explaining the housing 20 included in the waterproof connector 100 shown in FIG. 2.

As shown in FIGS. 4A, 4B, and 5, the second tubular portion 23 of the housing 20 is provided with a seal mounting portion 32 at an opening end portion. An inner diameter of the seal mounting portion 32 is larger than an inner diameter of parts of the second tubular portion 23 other than the seal mounting portion 32. The seal member 50 is to be fitted to the seal mounting portion 32. Locking claws 31 protruding inward are formed at an end portion of the first tubular portion 22, the end portion being closer to the bent portion 21 than the side of the first tubular portion 22 where the connection portion 13 is provided. The second tabular portion 23 has a thickened portion 33 at an end portion thereof closer to the bent portion 21 than the opening end portion. By having the thickened portion 33, the locking claw 31 is formed without difficulty on the end portion of the first tubular portion 22 in the vicinity of the bent portion 21. In addition, in the second tubular portion 23, since the thickened portion 33 is formed in the vicinity of the bent portion 21, a recessed portion 34 is formed in the vicinity of the seal mounting portion 32. The recessed portion 34 is formed on an inner peripheral surface of the second tubular portion 23 on a side where an inside corner is provided. Further, a positioning mark 35 is provided on an end surface of the second tubular portion 23. The positioning mark 35 is provided on the end surface of the second tubular portion 23 on the side where the inside corner is provided.

As shown in FIGS. 2 and 3, the inner member 40 is formed of a synthetic resin, and is fitted and attached to the first tubular portion 22 used as the connection portion 13 of the housing 20. In addition, locking pieces 42 each having a locking hole 41 are formed on the inner member 40. The locking piece 42 protrudes from the inner member 40 toward a direction in which the inner member 40 is fitted to the housing 20. In addition, a plurality of terminal accommodating holes 43 are formed in the inner member 40, and terminals 60 are inserted into the terminal accommodating holes 43. As a result, a plurality of terminals 60 are held in the inner member 40. The terminal 60 is formed of, for example, a conductive metal material such as copper or a copper alloy. Each of the terminals 60 has a terminal connection portion 61 having a pin shape to be connected to a terminal (not shown) of the mating connector and an electric wire connection portion 62 to which one end of the electric wire 17 is to be connected. The electric wire 17 is to be crimped to the electric wire connection portion 62 and the one end thereof is connected to the electric wire connection portion 62, so that an conductor inside the electric wire 17 is electrically connected to the terminal 60.

The inner member 40 holding the plurality of terminals 60 is fitted into the first tubular portion 22 with the other end of the electric wire 17 inserted first into the first tubular portion 22 and then into the second tubular portion 23 of the housing 20. The inner member 40 fitted into the first tubular portion 22 is fixed in the first tubular portion 22 of the housing 20 by the locking claw 31 configured to lock the locking hole 41 of the locking pieces 42.

Figure 6A:
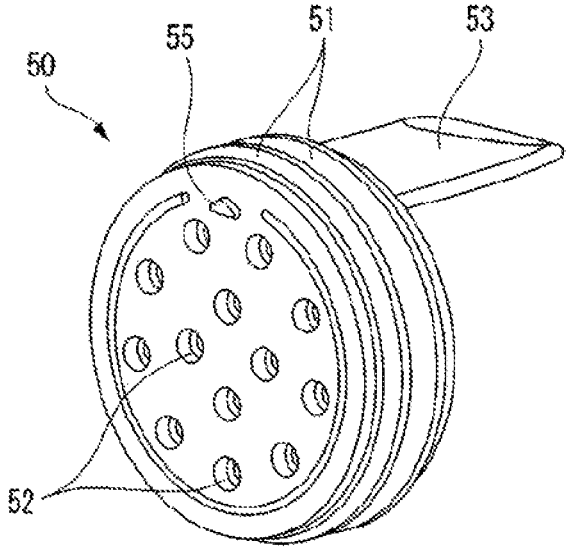
Figure 6B:
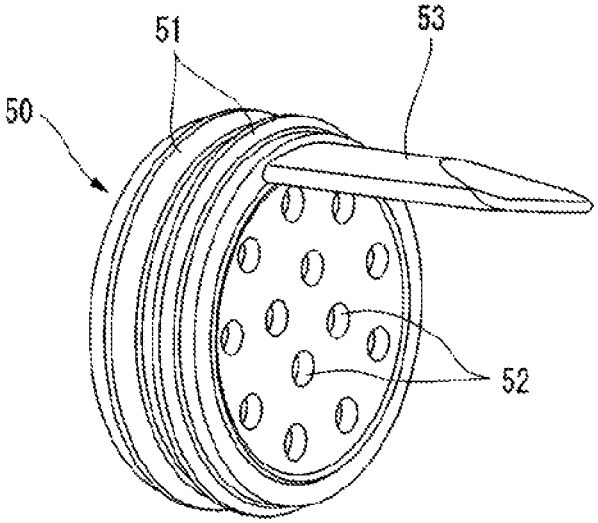
Figure 7:
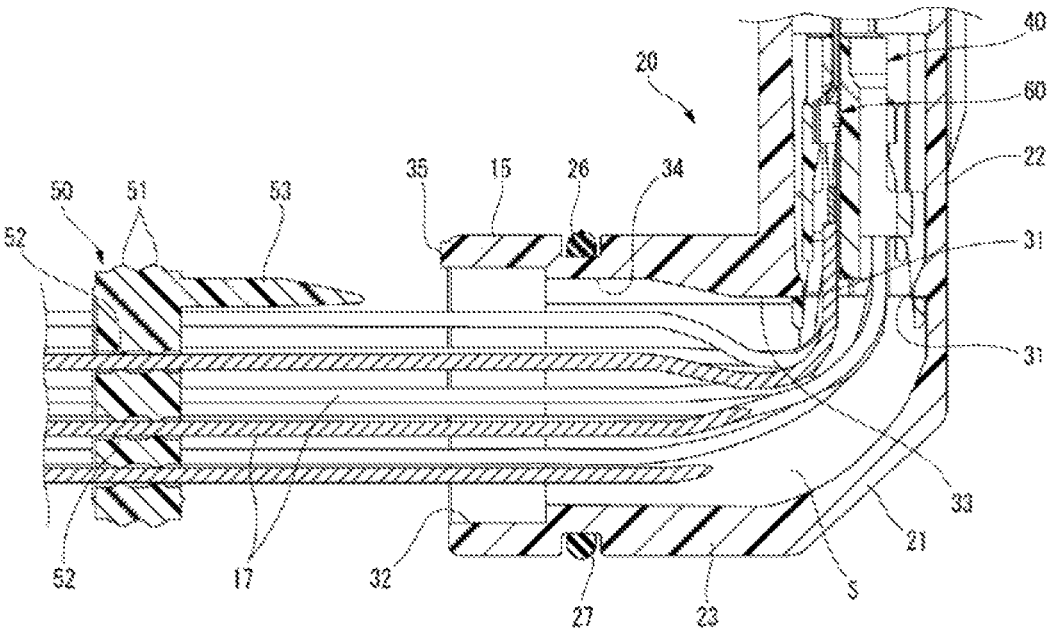
FIG. 7 is a longitudinal sectional view along the axial direction showing the second tubular portion of the housing before the seal member is mounted.
Figure 8:
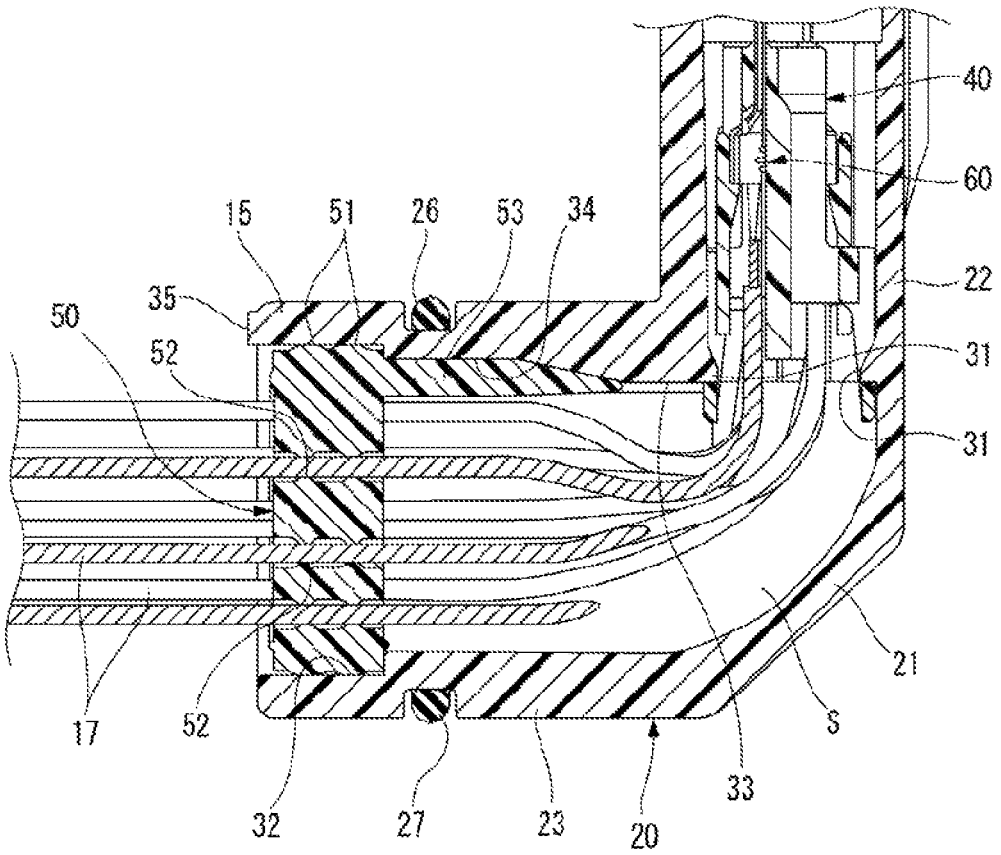
FIG. 8 is a longitudinal sectional view along the axial direction showing the second tubular portion of the housing after the seal member is mounted.
Figure 9:
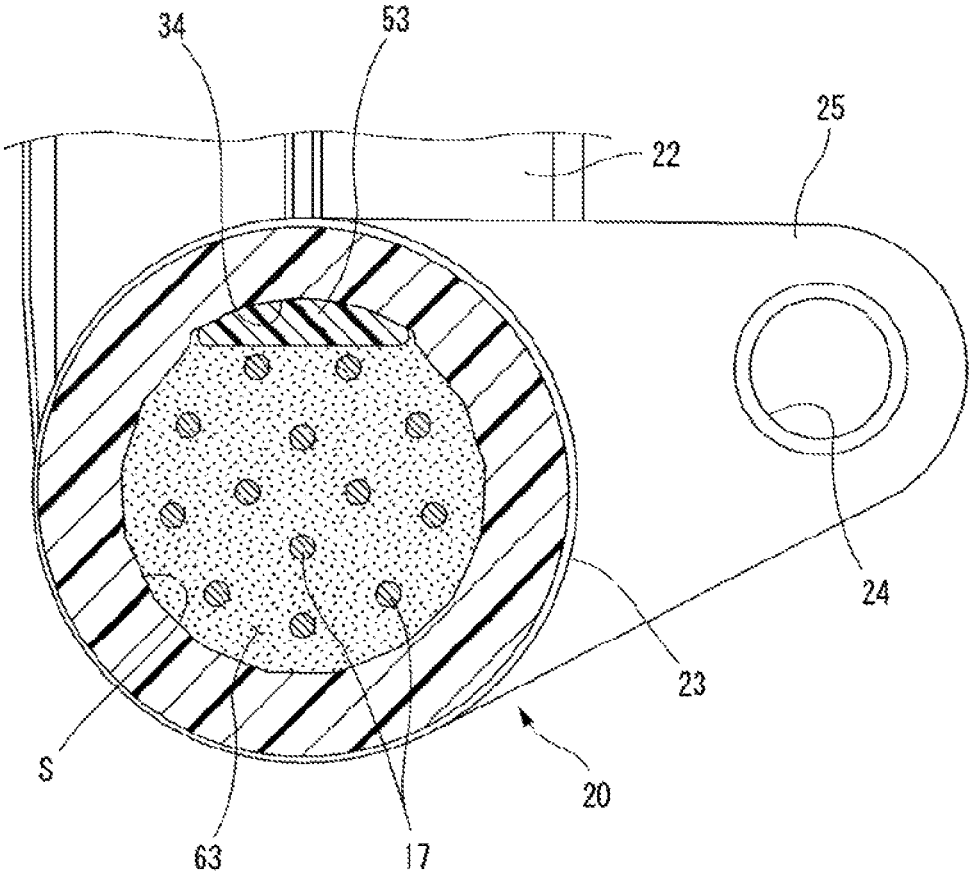
FIG. 9 is a sectional view taken along a line B-B in FIG. 3.

FIGS. 6A and 6B are views explaining the seal member 50 shown in FIG. 2, in which FIG. 6A is a perspective view as viewed from a front side, and FIG. 6B is a perspective view as viewed from a back side. FIG. 7 is a longitudinal sectional view along the axial direction showing the second tubular portion 23 of the housing 20 before the seal member 50 is mounted. FIG. 8 is a longitudinal sectional view along the axial direction showing the second tubular portion 23 of the housing 20 after the seal member 50 is mounted. FIG. 9 is a sectional view taken along a line B-B in FIG. 3.

As shown in FIGS. 6A and 6B, the seal member 50 is formed in a substantially disk shape. The seal member 50 is made of, for example, a synthetic resin material such as rubber. The seal member 50 has a plurality of lip portions 51 protruding from an outer peripheral surface. The lip portions 51 are formed over a circumferential direction of the seal member 50, and are arranged at intervals in the axial direction. The seal member 50 having the lip portions 51 has an outer diameter slightly larger than an inner diameter of the seal mounting portion 32 formed in the second tubular portion 23 of the housing 20. As a result, when the seal member 50 is fitted to the seal mounting portion 32, the lip portion 51 is to be pressed against the seal mounting portion 32 and contacts an inner peripheral surface of the seal mounting portion 32 in a pressed manner.

The seal member 50 has a plurality of electric wire insertion holes 52 running through front and back sides of the seal member 50, and the electric wires 17 each having the one end connected to the terminal 60 are passed through the electric wire insertion holes 52.

A protruding piece 53 is formed on the seal member 50. The protruding piece 53 is formed in the vicinity of an edge portion of a surface to face the second tubular portion 23 of the housing 20 when the seal member 50 is attached to the second tubular portion 23. The protruding piece 53 extends toward a direction in which the seal member 50 is attached to the second tubular portion 23 of the housing 20. The protruding piece 53 is formed in a shape that can be fitted into the recessed portion 34 formed in the second tubular portion 23. In addition, the seal member 50 is provided with a positioning mark 55 at an edge portion of another surface of the seal member 50 on an opposite side of the surface to face the second tubular portion 23 of the housing 20 when the seal member 50 is attached to the second tubular portion 23. The positioning mark 55 is provided on a position corresponding to the edge portion of the seal member 50 in the vicinity of which the protruding piece 53 is formed.

The seal member 50 is fitted and attached to the seal mounting portion 32 of the second tubular portion 23 of the housing 20 with the electric wire 17 being passed through the electric wire insertion hole 52. When the seal member 50 is mounted to the seal mounting portion 32, the lip portion 51 contacts the inner peripheral surface of the seal mounting portion 32 in a pressed manner. As a result, the end portion of the second tubular portion 23 of the housing 20 is sealed by the seal member 50. In this state, the seal member 50 is slightly compressed inward in a radial direction thereby sealing a gap between the inner peripheral surface of the electric wire insertion hole 52 and an outer peripheral surface of the electric wire 17.

The seal member 50 is mounted on the housing 20 by being fitted into the seal mounting portion 32 of the second tubular portion 23. At this time, the positioning mark 55 of the seal member 50 is aligned with the positioning mark 35 provided on the second tubular portion 23 of the housing 20. Then, as shown in FIG. 7, the protruding piece 53 of the seal member 50 is positioned with respect to the recessed portion 34 formed in the second tubular portion 23 of the housing 20. When the seal member 50 is fitted into the seal mounting portion 32 of the second tubular portion 23 and mounted to the housing 20 with the positioning mark 55 being aligned with positioning mark 35, the protruding piece 53 provided on the seal member 50 is complementarily fitted into the recessed portion 34 formed in the second tubular portion 23 as shown in FIG. 8. As a result, the recessed portion 34 of the second tubular portion 23 is fitted with the protruding piece 53 of the seal member 50.

A seal region S is provided between the inner member 40 and the seal member 50 inside the housing 20, and the seal region S is filled with the filler 65 and sealed. As the filler 65, for example, a thermosetting resin such as a silicone resin or an epoxy resin may be used. Further, the seal region S through which the electric wire 17 is passed is encapsulated and sealed by the filler 65. As a result, as shown in FIG. 9, in the second tubular portion 23 of the housing 20, a portion other than the recessed portion 34 fitted with the protruding piece 53 of the seal member 50 is filled with the filler 65 without any clearance and sealed.

How the seal region S inside the housing 20 is filled with the filler 65 is, for example, in the housing 20 to which the inner member 40 and the seal member 50 are attached, the housing 20 is placed so that an open end of the first tubular portion 22 faces upward and the second tubular portion 23 is arranged laterally. Then, the seal region S is filled with the liquid filler 65 by putting the filler 65 through a clearance or the like between the inner member 40 and an inner surface of the first tubular portion 22 from an upper side of the first tubular portion 22. Then, the filler 65 fills the seal region S gradually and accumulates from a lower side of the seal region S and eventually fills the entire seal region S.

Figure 10:
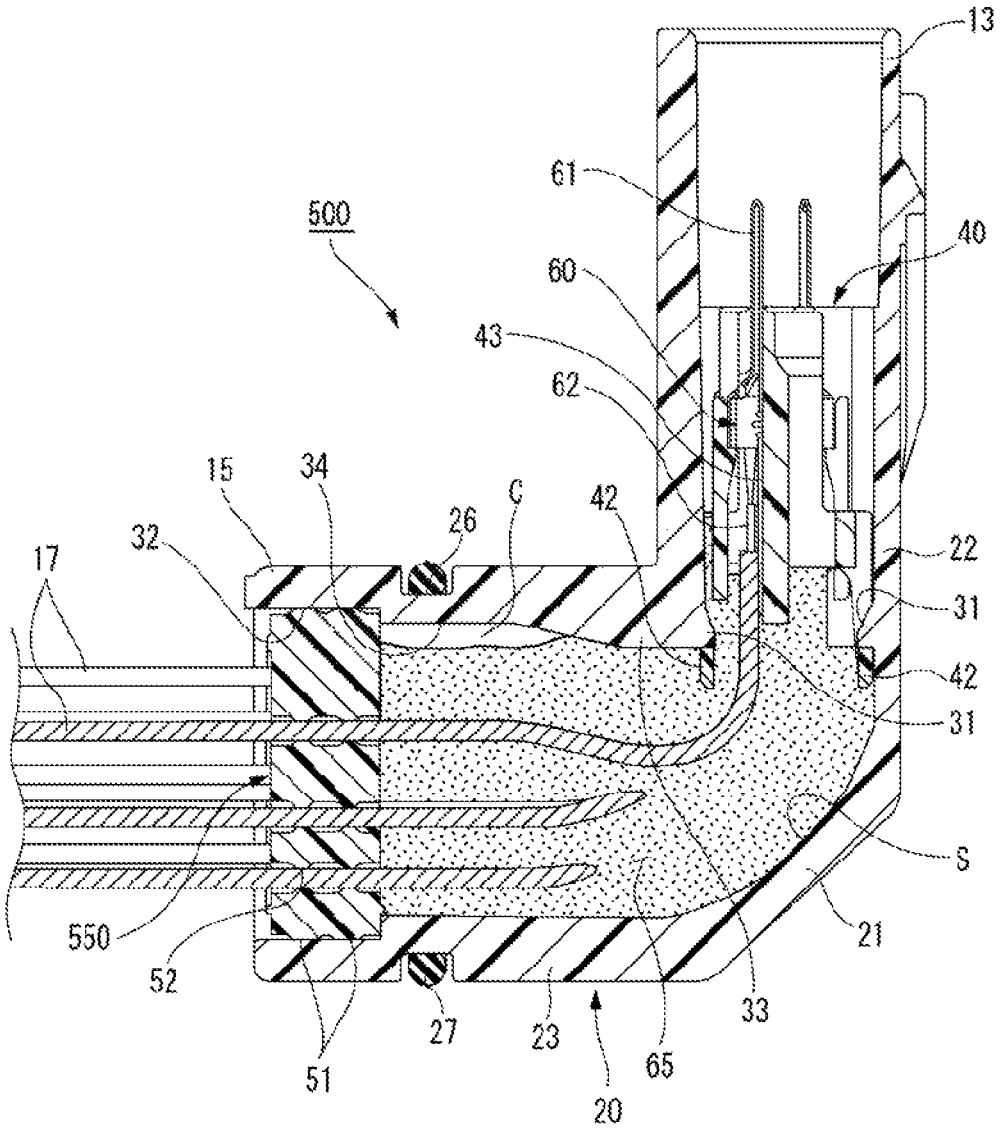
FIG. 10 is a longitudinal sectional view of a waterproof connector according to a reference example along an axial direction.

Here, a waterproof connector 500 according to a reference example will be described. FIG. 10 is a longitudinal sectional view of a waterproof connector 500 according to a reference example along the axial direction. As shown in FIG. 10, in the waterproof connector 500 according to the reference example, a seal member 550 without the protruding piece 53 is mounted to the seal mounting portion 32 of the second tubular portion 23 of the housing 20. In this reference example, the seal region S is gradually filled with the filler 65 from the lower side of the seal region S. At this time, since the housing 20 has the bent portion 21, there is a possibility that the filler 65 fails to be charged in an upper space in the second tubular portion 23 arranged laterally. In particular, in a case where the second tubular portion 23 has the recessed portion 34 in the inner peripheral portion by forming the thickened portion 33 on the inner peripheral portion of the second tubular portion 23 at the end portion thereof on the side of the bent portion 21 in order to form the locking claw 31, there is a possibility that air in the recessed portion 34 remains without coming out of the housing and an unfilled portion C is generated.

On the other hand, according to the waterproof connector 100 according to the embodiment, as shown in FIG. 3, when the seal member 50 is mounted to the second tubular portion 23 of the housing 20, the protruding piece 53 of the seal member 50 is fitted into the recessed portion 34 formed in the inner peripheral portion of the second tubular portion 23 on the side where the inside corner is provided, the recessed portion 34 is in the state of being fitted with the protruding piece 53. Therefore, when the filler 65 fills the seal region S between the inner member 40 and the seal member 50 from the opening end side of the first tubular portion 22 in the state in which the open end of the first tubular portion 22 faces upward and the second tubular portion 23 is arranged laterally, the filler 65 can fills the entire seal region S without leaving air in the recessed portion 34. As a result, it is possible to provide the waterproof connector 100 which is satisfactorily filled with the filler 65 and high sealing performance is ensured even if the housing 20 formed with the recessed portion 34 is provided by forming the thickened portion 33 on the inner peripheral portion of the second tubular portion 23 in the vicinity of the first tubular portion 22 in order to form the locking claw 31 for locking the inner member 40.

Since the protruding piece 53 of the seal member 50 is fitted into the recessed portion 34 formed in the inner peripheral portion of the second tubular portion 23 of the housing 20, the seal member 50 is easily positioned and mounted to the housing 20. Accordingly, an operator can easily recognize positional shift when the protruding piece 53 cannot be fitted into the recessed portion 34 sufficiently when a position of the seal member 50 is shifted in the circumferential direction with respect to the second tubular portion 23.

Figure 11:
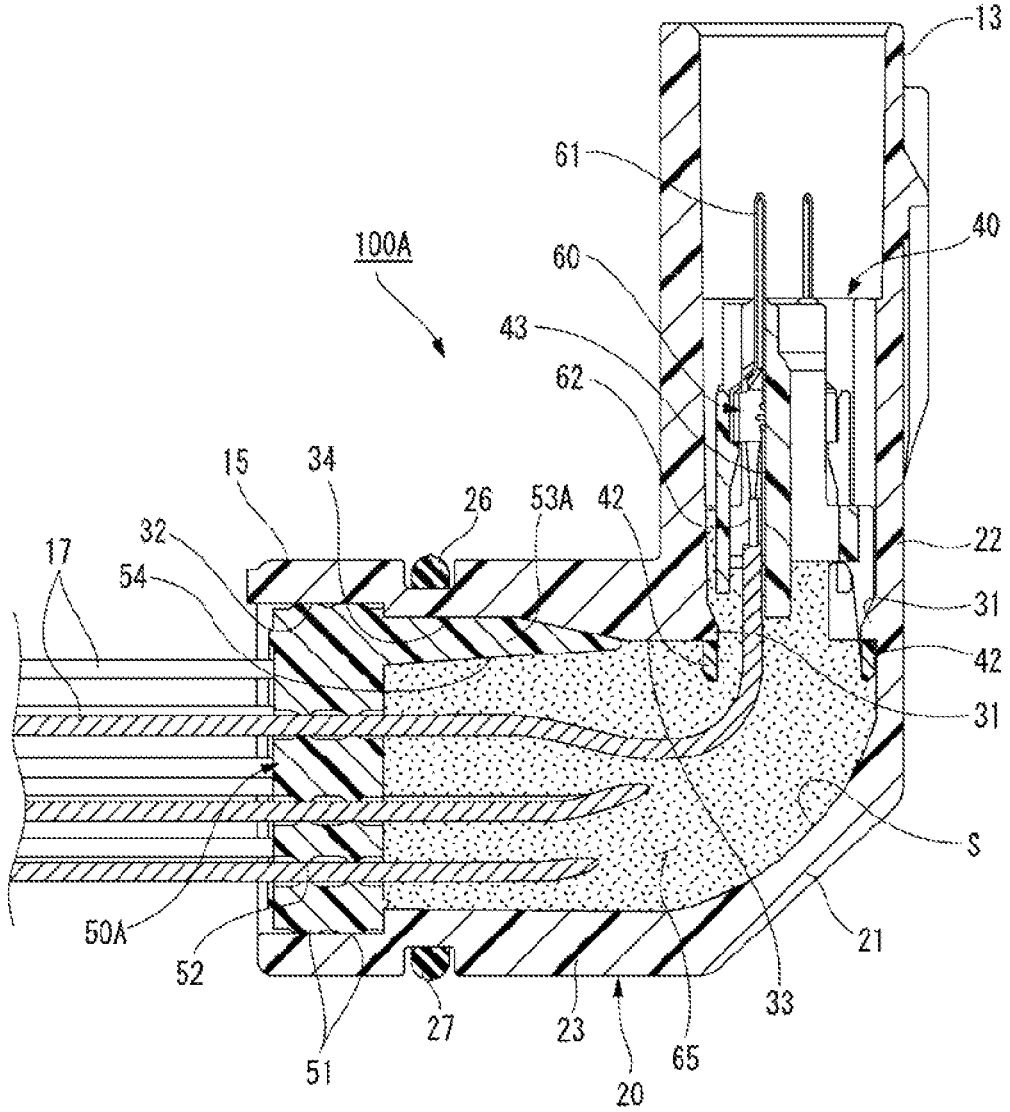
FIG. 11 is a longitudinal sectional view of a waterproof connector according to a modification of the embodiment along an axial direction.

FIG. 11 is a longitudinal sectional view of a waterproof connector 100A according to a modification of the embodiment along the axial direction. As shown in FIG. 11, a protruding piece 53A of a seal member 50A of the waterproof connector 100A according to the modification has a tapered surface 54 on an inner side surface that gradually inclines toward the first tubular portion 22 and the inside corner upward (an upper side in FIG. 11). In other words, the protruding piece 53A has a tapered tip end from which the seal member 50A is inserted into the second tubular portion 23 which the inner side surface is tapered. In this case, the filler 65 put into the seal region S of the housing 20 from the opening end of the first tubular portion 22 easily flows toward the first tubular portion 22 site along the tapered surface 54 formed on the inner side surface of the protruding piece 53A. Therefore, the seal region S can be more smoothly filled with the filler 65.

Figure 12:
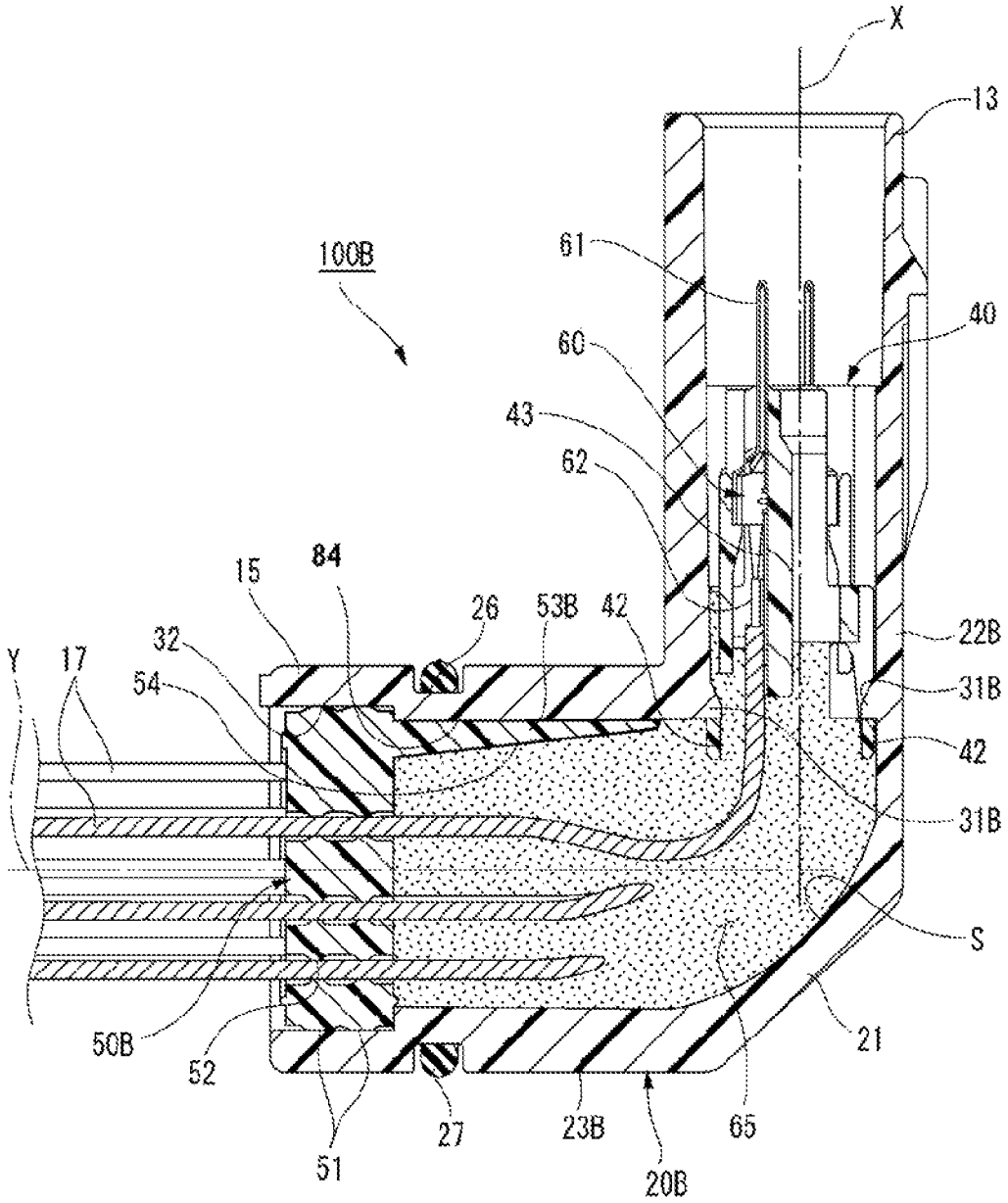
FIG. 12 is a longitudinal sectional view of a waterproof connector according to another embodiment of the present invention along an axial direction.

Next, a waterproof connector 100B according to another embodiment of the present invention will be described. The same components as those of the waterproof connector 100 of the embodiment described above are denoted by the same reference numerals, and a description thereof will be omitted. FIG. 12 is a longitudinal sectional view of the waterproof connector 100B according to the another embodiment along the axial direction.

As shown in FIG. 12, the waterproof connector 100B according to the another embodiment includes a housing 20B, the inner member 40, a seal member 50B, and the filler 65. The housing 20B has a first tubular portion 22B in which locking claws 31B formed at the end portion of the first tubular portion 22B in the vicinity of the bent portion 21 are provided closer to the opening end of the first tubular portion 22B than the locking claws 31 of the embodiment are to the opening end of the first tubular portion 22. Therefore, a second tubular portion 23B is not provided with the thickened portion 33 and the recessed portion 34. That is, in the waterproof connector 100B of the another embodiment, the second tubular portion 23B of the housing 20B has a same diameter portion 84 having the same inner diameter along the axial direction Y between an inner edge of the seal mounting portion 32 and the bent portion 21.

The seal member 50B has a protruding piece 53B to be arranged along an inner peripheral portion of the second tubular portion 23B on a side where the inside corner is provided. The protruding piece 53B extends toward a direction in which the seal member 50A is fitted to the second tubular portion 23B of the housing 20B. The protruding piece 53B has a cylindrical surface on an outer side corresponding to the inner peripheral portion of the second tubular portion 23B, and has a tapered surface on the inner side that gradually inclines toward the first tubular portion 22B and the inside corner. Therefore, an outer surface of the protruding piece 53B formed on the seal member 50B contacts the inner peripheral portion of the second tubular portion 23B having the same inner diameter along the axial direction Y.

According to the waterproof connector 100B according to the another embodiment, when the seal member 50B is mounted to the second tubular portion 23B of the housing 20B, the protruding piece 53B of the seal member 50B is to be arranged along the inner peripheral portion of the second tubular portion 23B on the side where the inside corner is provided. Therefore, when the filler 65 is injected into the seal region S between the inner member 40 and the seal member 50B from the opening end of the first tubular portion 22B with the open end of the first tubular portion 22B facing upward and the second tubular portion 23B being arranged laterally, the filler 65 flows along the tapered surface 54 formed on the inner side surface of the protruding piece 53B. Accordingly, the entire seal region S can be filled with the filler 65 without leaving air in the second tubular portion 23B on the side where the inside corner is provided. As a result, it is possible to provide the waterproof connector 100B which is satisfactorily filled with the filler 65 and the high sealing performance is ensured.

Therefore, according to the waterproof connectors 100, 100A, and 100B described above, it is possible to provide the waterproof connector which is satisfactorily filled with the filler 65 and the high sealing performance is ensured.

While the present invention has been described with reference to certain exemplary embodiments thereof, the scope of the present invention is not limited to the exemplary embodiments described above, and it will be understood by those skilled in the art that various changes and modifications may be made therein without departing from the scope of the present invention as defined by the appended claims.

According to an aspect of the embodiments described above, a waterproof connector (100, 100A) includes a housing (20) having a tubular shape and through which an electric wire (17) is inserted, the housing (20) including a first tubular portion (22) forming a first end of the housing and a second tubular portion (23) forming a second end of the housing, an inner member (40) configured to hold a terminal (60) connected to an end of the electric wire (17), the inner member (40) being configured to be fitted to the first tubular portion (22) at the first end of the housing, a seal member (50, 50A) having a wire insertion hole (52) through which the electric wire (17) is inserted, the seal member (50, 50A) being configured to be attached to the second tubular portion (23) at the second end of the housing and a filler (65) filling a space (for example, a seal region S) inside the housing (20) and between the inner member (40) and the seal member (50, 50A). The housing (20) has a bent structure such that the first tubular portion (22) and the second tubular portion (23) are connected to each other with an axial direction (X) of the first tubular portion (22) and an axial direction (Y) of the second tubular portion (23) intersecting each other. The second tubular portion (23) includes a recessed portion (34) on an inner peripheral portion of the second tubular portion (23) on a side where an inside corner of the bent structure of the housing (20) is provided. The seal member (50, 50A) includes a protruding piece (53, 53A) configured to be fitted into the recessed portion (34) when the seal member (50, 50A) is attached to the second tubular portion (23).

According to the waterproof connector having the above-described configuration, when the seal member is mounted to the second tubular portion of the housing, the protruding piece of the seal member is fitted into the recessed portion formed in the inner peripheral portion of the second tubular portion on the side where the inside corner is provided, and the recessed portion is fitted with the protruding piece. Therefore, when the filler is injected in the seal region between the inner member and the seal member from an opening end side of the first cylindrical portion with an opening end of the first tubular portion facing upward and the second tubular portion being arranged laterally, the entire seal region can be filled with the filler without leaving air in the recessed portion. As a result, it is possible to provide the waterproof connector which is satisfactorily filled with the filler and high sealing performance is ensured even if the housing formed with the recessed portion is provided by forming a thickened portion on the inner peripheral portion of the second tubular portion in the vicinity of the first tubular portion in order to form the locking claw or the like for locking the inner member, for example. In addition, since the protruding piece of the seal member is fitted into the recessed portion formed in the inner peripheral portion of the second tubular portion of the housing, the seal member is easily positioned and mounted to the housing. For example, with the second tubular portion having a cylindrical shape and the seal member having a disk shape, an operator can easily recognize positional shift of the seal member with respect to the second tubular portion even when a position of the seal member is shifted in a circumferential direction with respect to the second tubular portion.

The protruding piece (53A) may have a tapered surface (54) on an inner side of the protruding piece (53A), the tapered surface gradually inclining toward a tip end of the protruding piece (53A).

With this configuration, since the filler injected in the seal region of the housing from the opening end of the first tubular portion easily flows toward the first tubular portion along the tapered surface formed on the inner side surface of the protruding piece, the seal region can be more smoothly filled with the filler.

According to another aspect of the embodiments described above, a waterproof connector (100B) includes a housing (20B) having a tubular shape and through which an electric wire (17) is inserted the housing (20B) including a first tubular portion (22B) forming a first end of the housing and a second tubular portion (23B) forming a second end of the housing, an inner member (40) configured to hold a terminal (60) connected to an end of the electric wire (17), the inner member (40) being configured to be fitted to the first tubular portion (22B) at the first end of the housing, a seal member (50B) having a wire insertion hole (52) through which the electric wire (17) is inserted, the seal member (50B) being configured to be attached to the second tubular portion (23B) at the second end of the housing and an filler (65) filling a space (for example, a seal region S) inside the housing (20B) and between the inner member (40) and the seal member (50B). The housing (20B) has a bent structure such that the first tubular portion (22B) and the second tubular portion (23B) are connected to each other with an axial direction (X) of the first tubular portion (22B) and an axial direction (Y) of the second tubular portion (23B) intersecting each other. The seal member (50B) includes a protruding piece (53B) configured to extend, when the seal member (50B) is attached to the second tubular portion (23B), along an inner peripheral portion of the second tubular portion (23B) on a side where an inside corner of the bent structure of the housing (20B) is provided. The protruding piece (53B) has a tapered surface (54) on an inner side of the protruding piece (53B), the tapered surface gradually inclining toward a tip end of the protruding piece (53B).

According to the waterproof connector having the above-described configuration, when the seal member is mounted to the second tubular portion of the housing, the protruding piece of the seal member is to extend along the inner peripheral portion of the second tubular portion on the side where the inside corner of the housing is provided. Therefore, when the filler is injected into the seal region between the inner member and the seal member from the opening end of the first tubular portion with the open end of the first tubular portion facing upward and the second tubular portion being arranged laterally, the filler easily flows toward the first tubular portion side along the tapered surface formed on the inner side surface of the protruding piece. Accordingly, the entire seal region can be filled with the filler without leaving air in the second tubular portion on the side where the inside corner is provided. As a result, it is possible to provide the waterproof connector which is satisfactorily filled with the filler and high sealing performance is ensured.

What is claimed is:

1. A waterproof connector comprising:

a housing having a tubular shape and through which an electric wire is inserted, the housing comprising a first tubular portion extending in a first axial direction forming a first end of the housing and a second tubular portion extending in a second axial direction and forming a second end of the housing;

an inner member configured to hold a terminal connected to an end of the electric wire, the inner member being configured to be fitted to the first tubular portion at the first end of the housing;

a seal member having a wire insertion hole through which the electric wire is inserted, the seal member being configured to be attached to the second tubular portion at the second end of the housing by insertion of the seal member into the second tubular portion in the second axial direction; and a filler filling a space inside the housing and between the inner member and the seal member, wherein the housing has a bent structure such that the first tubular portion and the second tubular portion are connected to each other with the first axial direction of the first tubular portion and the second axial direction of the second tubular portion intersecting each other so as to define an inside corner, wherein the second tubular portion comprises a recessed portion on an inner peripheral portion of the second tubular portion on a side where the inside corner of the bent structure of the housing is provided, and wherein the seal member comprises a body portion and a protruding piece protruding from the body portion in the second axial direction of the second tubular portion so as to be fitted into the recessed portion when the seal member is attached to the second tubular portion.

2. The waterproof connector according to claim 1, wherein the protruding piece has a tapered surface on an inner side of the protruding piece, the tapered surface gradually inclining toward a tip end of the protruding piece.

3. The waterproof connector according to claim 1, wherein the protruding piece protrudes from the body portion of the seal member in a direction perpendicular to another direction in which the body portion extends.

4. The waterproof connector according to claim 1, wherein the body portion of the seal member is formed in a substantially disk shape.

5. The waterproof connector according to claim 1, wherein the protruding piece is formed in a plate shape.

6. The waterproof connector according to claim 5, wherein the protruding piece has a tapered surface on a surface of the protruding piece, the surface being to face, when the seal member is attached to the second tubular portion, in an outer direction in a radial direction of the second tubular portion, the tapered surface being formed such that a thickness of the protruding piece in the radial direction decreases toward a tip end of the protruding piece.

7. A waterproof connector comprising:

a housing having a tubular shape and through which an electric wire is inserted the housing comprising a first tubular portion extending in a first axial direction and forming a first end of the housing and a second tubular portion extending in a second axial direction and forming a second end of the housing;

an inner member configured to hold a terminal connected to an end of the electric wire, the inner member being configured to be fitted to the first tubular portion at the first end of the housing;

a seal member having a wire insertion hole through which the electric wire is inserted, the seal member being configured to be attached to the second tubular portion at the second end of the housing by insertion of the seal member into the second tubular portion in the second axial direction; and an filler filling a space inside the housing and between the inner member and the seal member, wherein the housing has a bent structure such that the first tubular portion and the second tubular portion are connected to each other with the first axial direction of the first tubular portion and the second axial direction of the second tubular portion intersecting each other so as to define a corner portion, wherein the seal member comprises a body portion and a protruding piece protruding from the body portion in the second axial direction of the second tubular portion so as to extend, when the seal member is attached to the second tubular portion, along an inner peripheral portion of the second tubular portion on a side where the inside corner of the bent structure of the housing is provided, and wherein the protruding piece has a tapered surface on an inner side of the protruding piece, the tapered surface gradually inclining toward a tip end of the protruding piece.

8. The waterproof connector according to claim 7, wherein the protruding piece protrudes from the body portion of the seal member in a direction perpendicular to another direction in which the body portion extends.

9. The waterproof connector according to claim 7, wherein the body portion of the seal member is formed in a substantially disk shape.

10. The waterproof connector according to claim 7, wherein the protruding piece is formed in a plate shape.

* * * * *